US007584902B2

(12) United States Patent
Sibbers et al.

(10) Patent No.: US 7,584,902 B2
(45) Date of Patent: Sep. 8, 2009

(54) METHOD AND DEVICE FOR CREATING MARKING LINES

(75) Inventors: Hartwig Sibbers, Hamburg (DE); Klaus-Dieter Reidath, Tangstedt (DE)

(73) Assignee: Hofmann GmbH Maschinenfabrik und Vertrieb, Rellingen (DE)

( * ) Notice: Subject to any disclaimer, the term of this patent is extended or adjusted under 35 U.S.C. 154(b) by 0 days.

(21) Appl. No.: 10/583,834

(22) PCT Filed: Dec. 22, 2004

(86) PCT No.: PCT/EP2004/014604

§ 371 (c)(1),
(2), (4) Date: Jun. 3, 2008

(87) PCT Pub. No.: WO2005/064082

PCT Pub. Date: Jul. 14, 2005

(65) Prior Publication Data

US 2008/0236485 A1 Oct. 2, 2008

(30) Foreign Application Priority Data

Dec. 23, 2003 (DE) ..... 103 61 531

(51) Int. Cl.

| | |
|---|---|
| ***E01C 23/20*** | (2006.01) |
| ***E01C 23/16*** | (2006.01) |
| ***E01C 19/16*** | (2006.01) |
| ***E01C 19/12*** | (2006.01) |
| ***B05B 9/06*** | (2006.01) |
| ***B05B 1/32*** | (2006.01) |
| ***E01H 3/02*** | (2006.01) |

(52) U.S. Cl. ..... 239/100; 239/156; 239/172; 239/451; 404/94

(58) Field of Classification Search ..... 239/99, 239/100, 146, 150, 155, 156, 172, 391–393, 239/396, 451, 455, 537–539, 597; 404/93, 404/94; 118/300, 301, 305
See application file for complete search history.

(56) References Cited

U.S. PATENT DOCUMENTS 430,784 A 6/1890 Mulford (Continued)

FOREIGN PATENT DOCUMENTS

| | | |
|---|---|---|
| DE | 3029909 | 3/1982 |
| DE | 43 27 701 A1 | 2/1995 |
| EP | 0 655 533 | 11/1994 |

(Continued)

*Primary Examiner*—Darren W Gorman
(74) *Attorney, Agent, or Firm*—Greer, Burns & Crain, Ltd

(57) ABSTRACT

A device carried on a moving vehicle for creating marking lines, which are a plurality of elements and are made of a highly viscous marking material, on a surface that is to be marked. The device includes a housing formed by walls and a discharge slot formed in at least one of the walls of the housing and extending transversely to a direction of movement of the vehicle, the discharge slot being limited in extent by a front discharge slot edge and a rear discharge slot edge, seen in the direction of movement of the vehicle. A pressurized material supply line leads to an interior of the housing. A rotatable hollow cylinder formed of a jacket is located in the interior of the housing and is arranged to rotate with the movement of the vehicle carrying the device. The cylinder is provided with a plurality of passages through the jacket, which, depending on a rotary position of the cylinder, establish a connection between the pressurized material supply line and the discharge slot. The rotary cylinder is positioned in the housing with an outer circumferential surface of its jacket spaced at a distance from the walls of the housing and essentially forms a sealing gap only in an area of the discharge slot edges.

20 Claims, 12 Drawing Sheets

U.S. PATENT DOCUMENTS

| | | | | | |
|---|---|---|---|---|---|
| 1,626,879 | A | | 5/1927 | Shidler et al. | |
| 3,220,653 | A | * | 11/1965 | Waldrum | 239/97 |
| 4,105,354 | A | | 8/1978 | Bowman | |
| 4,322,177 | A | * | 3/1982 | Eigenmann | 404/83 |
| 4,607,978 | A | * | 8/1986 | Eigenmann | 404/73 |
| 4,667,879 | A | * | 5/1987 | Muller | 239/133 |
| 6,382,872 | B1 | | 5/2002 | Winterskov | |

FOREIGN PATENT DOCUMENTS

| | | |
|---|---|---|
| EP | 0 924 345 | 6/1999 |
| WO | WO 86/01748 | 3/1986 |
| WO | WO 94/16149 | 7/1994 |
| WO | WO 99/22073 | 5/1999 |
| WO | WO 03/006744 | 1/2003 |

* cited by examiner

Fig. 4
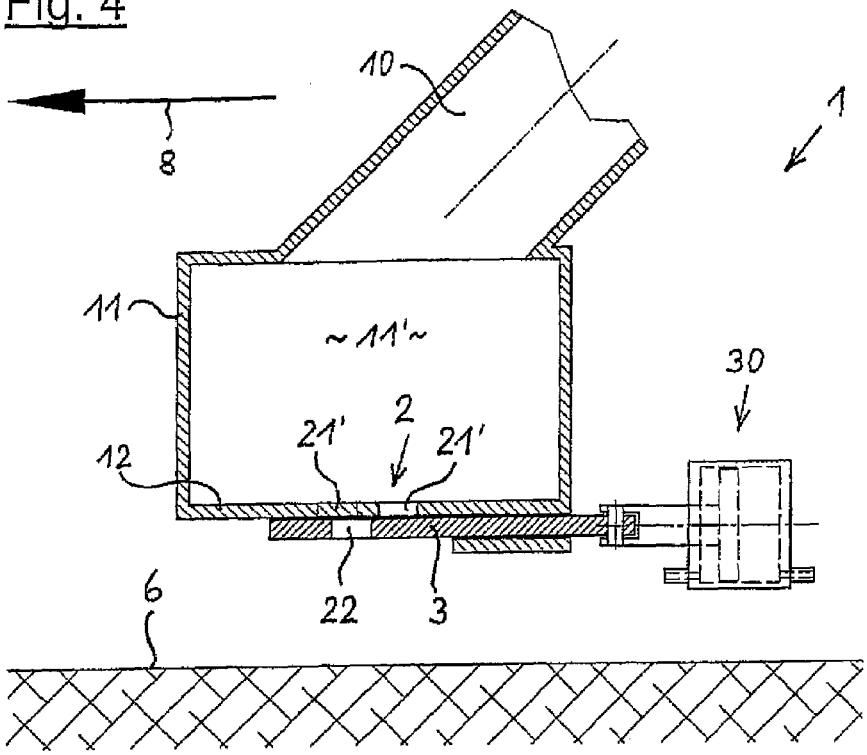
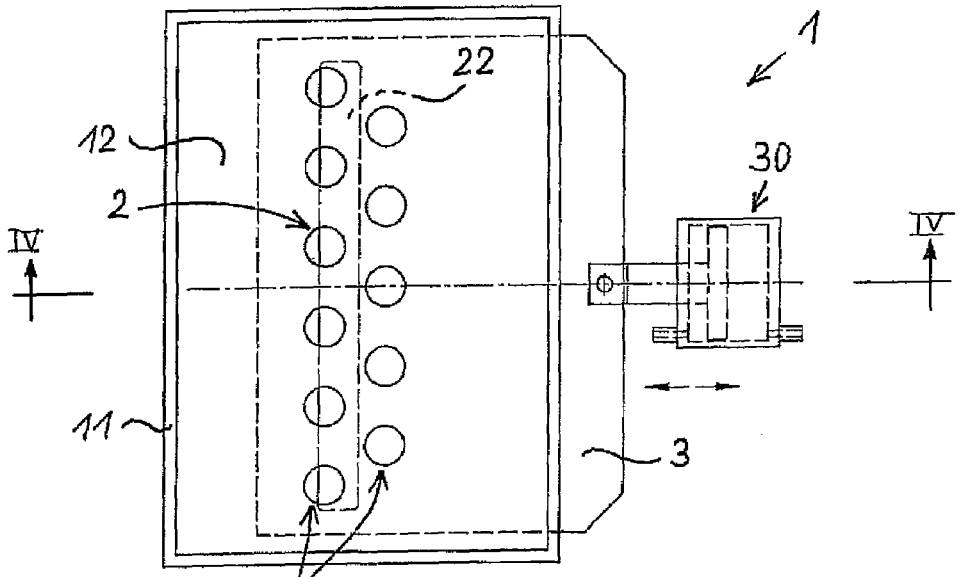
Fig. 3

Fig. 6
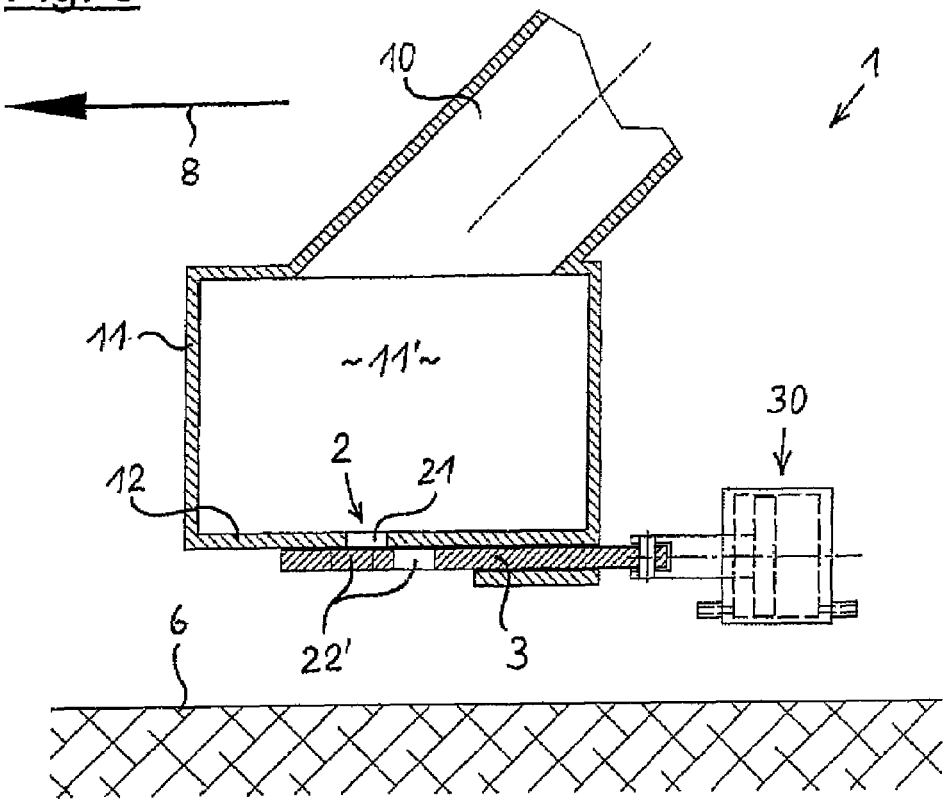
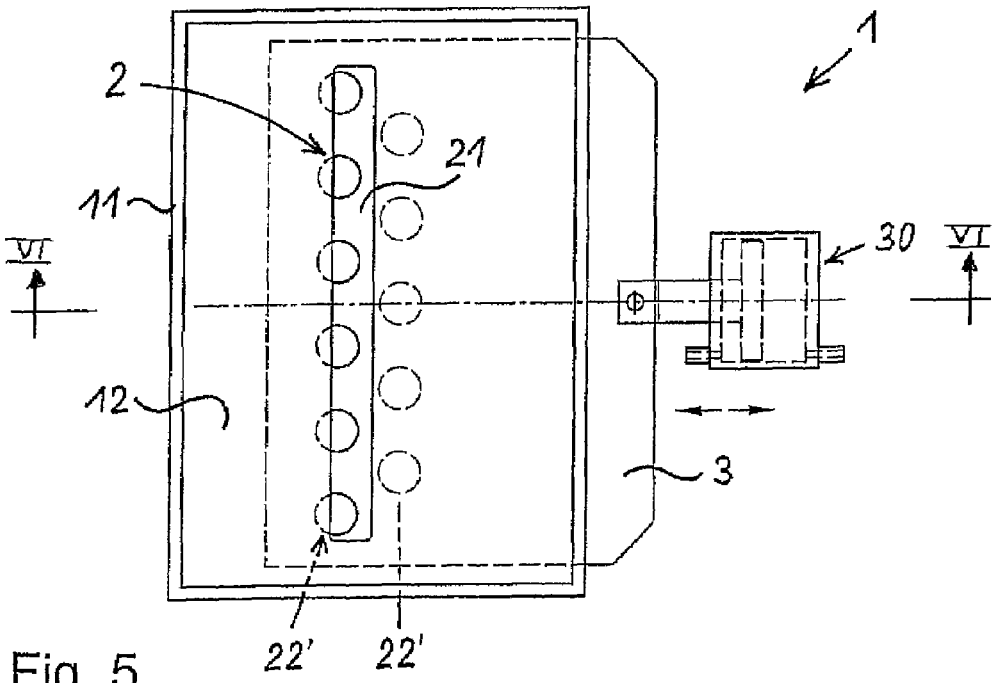
Fig. 5

Fig. 8
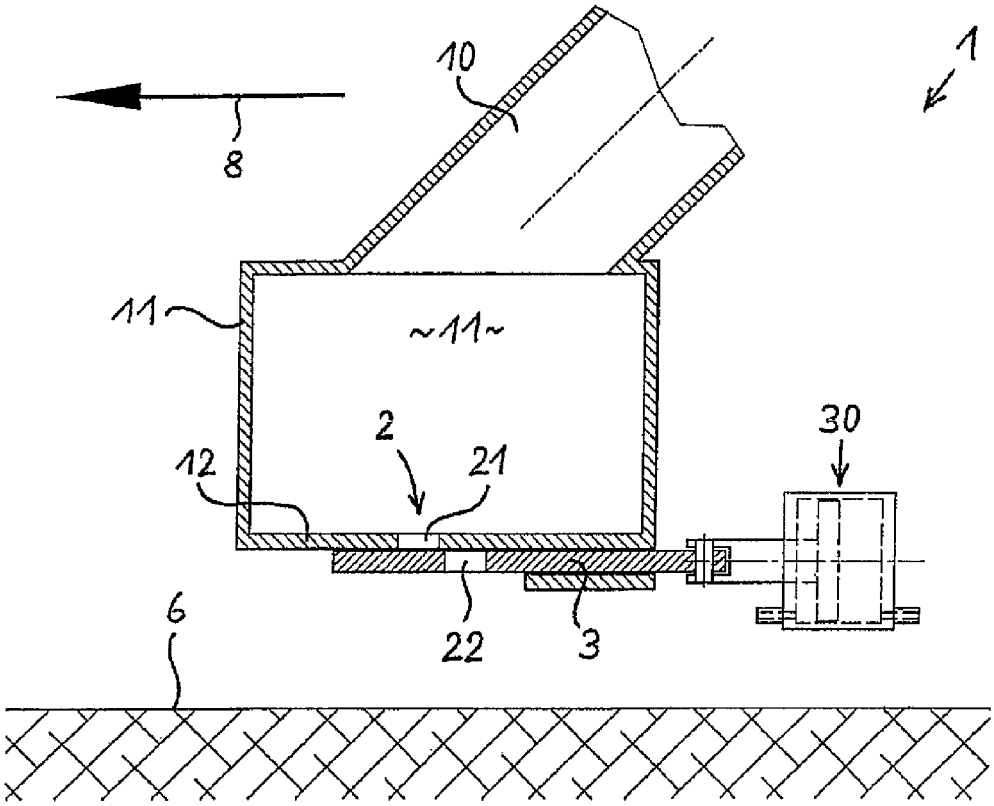
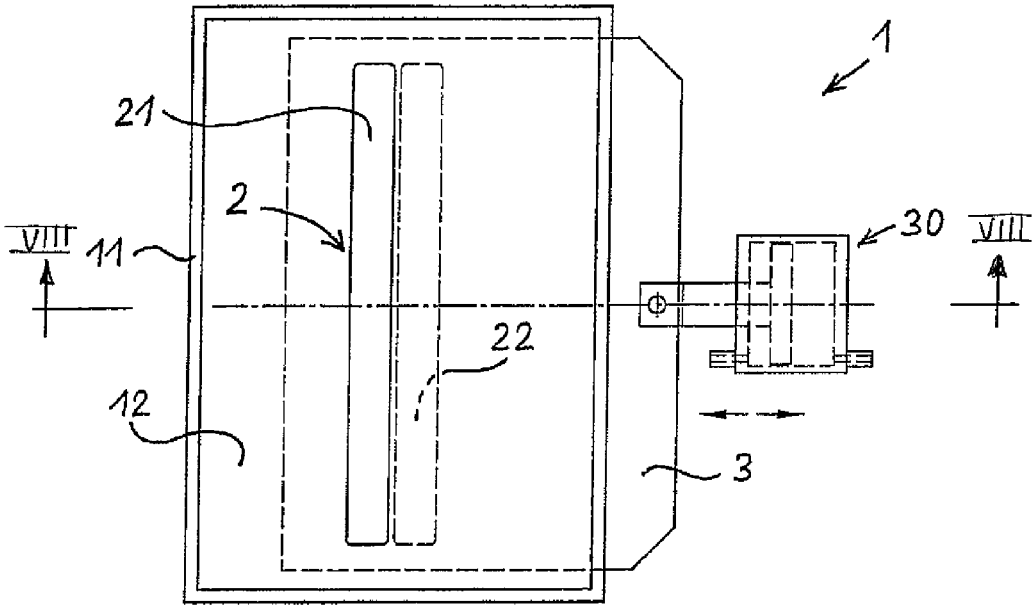
Fig. 7

METHOD AND DEVICE FOR CREATING MARKING LINES

BACKGROUND OF THE INVENTION

This invention relates to a method for creating marking lines comprising a plurality of elements and comprising a highly viscous marking material on a surface that is to be marked, especially a road surface, with pressurized marking material being discharged through an outlet that can be opened and closed while being moved relative to the surface. Moreover, the invention relates to a device for creating marking lines comprising a plurality of elements and comprising of a highly viscous marking material on a surface that is to be marked, especially a road surface; by means of the device, pressurized marking material can be discharged through an outlet that can be opened and closed while being moved relative to the surface.

For the creation of such markings, the methods and devices according to the documents DK 166 378 and PCT/DK 98/00446 have so far become known.

In both known methods, the material emerges as a continuous strip from a slot whose width corresponds to the width of the marking line, and said material is separated by a rotating cutting and ejecting device with paddles or vanes and ejected onto the road surface.

A disadvantage of these methods presents the wetting of the cutting and ejecting device rotating outside of the housing holding the material and having the outlet slot. Marking material will not only be ejected on the desired places of the road surface but, depending on the speed and depending on the material collecting on the ejecting device, also in portions of uncontrolled size in other radial directions as well. There is accordingly a major influence of moving speed and thus also the rotary speed of the ejecting device. One part of this material ejected in an uncontrolled manner actually does get onto the road surface, but not at the desired places. Another part of the uncontrolled ejected material which is not desired on the road surface must be trapped by spray protection devices in which the trapped material will collect in turn. This will result in regular interruptions of the work to free spray protection devices from the material collected there. For material to be processed hot and solidifying when cooling, there will be additional problems due to material solidifying on the ejecting and spray protection devices when these devices are not heated which is expensive and problematic.

Another problem presents the creation of exact ends of the marking lines. Although the material discharge from the housing can be abruptly started and ended by abruptly opening and closing the discharge slot; yet, with the known devices, material collected on the cutting and ejecting device will still continue to be ejected, over a longer distance, in an uncontrolled manner and only gradually abating. Additionally, over a longer distance, material collected on the spray protection devices will drip which also results in undesirable "contaminations" in the breaks of the marking lines. A successful prevention of these undesirable material applications in the marking line breaks will require complex measures, e.g. providing collection pans underneath.

From DE 43 27 701 C2, a method is known for the application of a highly viscous marking material in several layers parallel with each other on a stationary surface. Moreover, this document describes an application device for the implementation of the method. This method provides that each of the layers is applied pre-selectably in one of two different thicknesses. In the device for the implementation of this method, several closing elements are arranged side by side on its discharge side, the elements being movable independently from each other between a closing position and an adjustable opening position, in which the corresponding closure element releases a discharge slot of a predetermined width, with each of the closing elements being movable independently from the others into a second opening position in which one discharge slot is provided with a second pre-definable width. According to this method and the pertinent device, marking lines can be created which have, area-specifically, different thicknesses, in longitudinal direction of the marking lines as well as in a transverse direction thereto. The closing elements of the device have three operating conditions, i.e. "closed", "smaller width" and "larger width". The closing elements between these three positions are reset pneumatically or hydraulically without intermediate positions being assumed for any appreciable periods of time. The marking lines thus created have a very regular pattern which usually consists of a full-area basic layer and of rectangular surfaces which are elevated relative thereto. This method and the pertinent device are not suitable for creating marking lines comprising a plurality of especially droplet-shaped elements.

SUMMARY OF THE INVENTION

It is the objective of the invention to remedy the aforementioned disadvantages and especially to improve the precision of the material application in terms of size and quality of the individual marking line elements, to facilitate the adjustability of the device, to enable the creation of different types of marking lines, to improve the reproducibility of the look of the marking lines, and to ensure the problem-free functioning of the device in varying the speed of movement in a great speed range.

For the method, it is provided that the marking material is passed through an opening upstream of the outlet or forming the outlet and that the opening cross section of the opening is periodically modified during movement relative to the surface by means of a first, fixed discharge element and a second discharge element which rests against the first discharge element so as to cooperate therewith and is moved relative thereto in an oscillating or rotating fashion on a contact plane.

The movement of the first and the second discharge element relative to each other achieves, in particular, a steady increase and reduction of the opening cross section, that means a change with fluid passages, thus achieving the desired surface form of the marking line which is composed of droplet-like points or convex bulges. In contrast, an undesirable sudden opening and closing of the opening cross section is here avoided.

For the purpose of creating elements of a more round or more oval base area, the opening cross sections are to change correspondingly in their width, i.e. in their length transversely to the direction of movement, upon the movement relative to the road surface. For the purpose of creating elements of a rather rectangular base area, the opening cross sections are to comprise always the same width from opening to closing.

For the device according to the invention, it is provided that it comprises an opening for the marking material upstream of the outlet or forming the outlet and that the opening cross section of the opening is periodically modifiable during movement of the device relative to the surface by means of a first, fixed discharge element and a second discharge element which rests against the first discharge element so as to cooperate therewith and is moved relative thereto in an oscillating or rotating fashion on a contact plane.

This device according to the invention can be designed in different ways and manners.

A first embodiment provides that the device comprises a housing with a housing bottom forming the first, fixed discharge element, with at least one discharge slot extending transversely to the direction of movement or at least one row of several discharge openings arranged side by side and extending transversely to the direction of movement, and that the opening cross section of the opening is modifiable by a single slide forming the second discharge element and slidable in an oscillating manner in and against the direction of movement, the slide comprising at least one discharge slot extending transversely to the direction of movement or at least one row, extending transversely to the direction of movement, the row comprising several discharge openings arranged side by side. The mentioned discharge elements with a slot or opening row on the one hand in the housing bottom and on the other hand in the slide can be combined arbitrarily with each other, depending on the type of marking line to be created.

An alternative embodiment provides that the device comprises a housing with one housing bottom forming the first, fixed discharge element, the housing bottom comprising several discharge openings arranged side by side transversely to the direction of movement, and that the opening cross section of the opening is modifiable by means of one own slide per discharge opening, slidable in an oscillating manner in and against the direction of movement and forming the second discharge element. With this embodiment of the device as well, marking lines can be created comprising a plurality of elements.

The oscillating movement of the slides can be generated by suitable mechanical drives, e.g. in a driving manner via a crank drive or pneumatically or hydraulically via piston cylinder units, preferably also with a variable oscillation frequency. To avoid undesirable changes in the look of the markings upon changes of the speed of movement relative to the surface to be marked, it is preferably provided, however, that the device comprises a slide drive to ensure a sliding of the slide/slides with a frequency proportional to a speed of movement of the device relative to the surface. The proportionality of the slide drive to the speed of movement of the device can be simply achieved e.g. such that the slider drive being taken over by a travel drive of the device by means of several wheels carrying the device and rolling on the surface to be marked or coupled with at least one of the wheels.

According to an alternative embodiment of the device, it is provided that the device comprises a housing with a housing bottom forming the first, fixed discharge element and comprising a slot-shaped discharge opening arranged transversely, seen in the direction of movement, and that the opening cross section of the opening is modifiable by means of a hollow cylinder forming the second discharge element and rotatably movable by means of an axis extending transversely to the direction of movement, said hollow cylinder having discharge openings arranged in its jacket surface. The rotation of the hollow cylinder during the movement of the device provides for a steady-periodic opening and closing of the openings by means of the steadily changing covering of the discharge openings in the rotating cylinder jacket on the one hand and in the housing bottom on the other hand.

It is furthermore proposed that the discharge openings in the hollow cylinder are formed by round or polygonal openings arranged staggered to each other in its circumferential direction as well as in its axial direction. With this hollow cylinder, marking lines can be created from a plurality of marking material points or droplets.

Alternatively thereto, the second discharge openings in the hollow cylinder forming the second discharge element are formed by slot-shaped openings extending parallel to the axial direction and arranged staggered to each other in its circumferential direction. With this hollow cylinder, marking lines can be created from a plurality of bulge-shaped marking material elements aligned transversely to the longitudinal direction of the marking lines.

A technically relatively simple and at the same time functional design is achieved by the hollow cylinder preferably resting, with the outer circumference of its cylinder jacket, in a sliding manner against two discharge opening edges limiting, on the front and on the rear, the slot-shaped discharge opening in the housing bottom, seen in the direction of movement. These discharge opening edges form one part of the housing bottom and provide, in cooperation with the outer circumference of the hollow cylinder, for the necessary seal between the device parts which are moved relative to each other, to avoid an uncontrolled escape of marking material in other ways than through the openings provided.

The slot forming the discharge opening in the housing bottom and extending transversely to the direction of movement is preferably designed with a length which is equivalent to a desired width of the marking lines. Should marking lines of different width be created with the device, the slot can be provided with an adjustable arrangement for changing and determining its length.

It is furthermore provided that at least one open/closed slide is allocated to the discharge opening in the housing bottom which forms at least one discharge opening edge adjustable in an adjusting direction parallel to the direction of movement. By means of this open/closed slide, the outlet can be closed, if needed, especially in case of breaks in the marking line to be created or at a marking line end, quickly and completely and independently of the hollow cylinder, and it can be opened just as fast, especially at the beginning of a marking line to be created, after which the discharge of marking material is controlled by the hollow cylinder. The line beginnings and the line ends created in this manner will then comprise, even with marking lines comprising a plurality of elements in accordance with the invention, the same short transitional zones as the usual full-surface marking lines created with a material discharge slot to be opened and closed.

According to another feature of the invention, the hollow cylinder can be displaced into a position spaced apart from the discharge opening edges. With the hollow cylinder in the position spaced apart from the discharge opening edges in which free material flow towards the outlet is then ensured within the chamber, the device can be retrofitted and is suitable in the most simple manner for creating the usual full-surface smooth marking lines.

The hollow cylinder can be made to rotate e.g. by a suitable motorized rotary drive, preferably with variable speed. To avoid undesirable changes of the look of the markings, even for the device with a hollow cylinder, upon changes of the speed of movement relative to the surface to be marked, it is preferably provided, however, that the device comprises a drive ensuring a driving of the hollowing cylinder with a speed which is proportional to the speed of movement of the device relative to the surface. The proportionality of the hollow cylinder rotary drive to the speed of movement of the device can here again be simply achieved for example by the hollow cylinder rotary drive being taken over by a travel drive of the device with several wheels carrying the device and rolling on the surface to be marked or coupled with at least one of the wheels.

To be able to use one and the same device in the most versatile fashion, i.e. for the creation of many different types of marking lines, it is preferably provided that the housing or the housing bottom and/or the hollow cylinder each form an exchangeable part of the device. Prior to its use, the user of the device need then only select and install the suitable device parts for the marking line to be respectively created. Connections or connecting means are used which can be preferably engaged and disengage without tools. Several devices for different marking lines will no longer be necessary.

Independent of its concrete design, the device is expediently arranged on a self-propelled vehicle with wheels, drive and steering or alternatively on a drawn vehicle with wheels, thus a trailer.

Should hot marking materials be processed which are to be heated until their application, it will be sufficient to heat only the housing.

BRIEF DESCRIPTION OF THE DRAWING

In the following, exemplary embodiments of the invention are explained on the basis of a drawing. The FIGS. of the drawing show:

FIG. 3 illustrates a first device in a top view;

FIG. 4 illustrates the device of FIG. 3 in a vertical section along line IV-IV in FIG. 3;

FIG. 5 illustrates a second device in a top view;

FIG. 6 illustrates the device of FIG. 5 in a vertical section along line VI-VI in FIG. 5;

FIG. 7 illustrates a third device in a top view;

FIG. 8 illustrates the device of FIG. 7 in a vertical section along line VIII-VIII in FIG. 7;

DETAILED DESCRIPTION OF THE PREFERRED EMBODIMENT

The examples described hereinafter of the device 1 according to the invention are used for creating marking lines 7 which comprise a plurality of elements 70 and are made of a highly viscous marking material on a surface 6 that is to be marked, especially a road surface. Two examples for such marking lines 7 are presented in FIGS. 1 and 2 in a top view as line sections.

Figure 1:
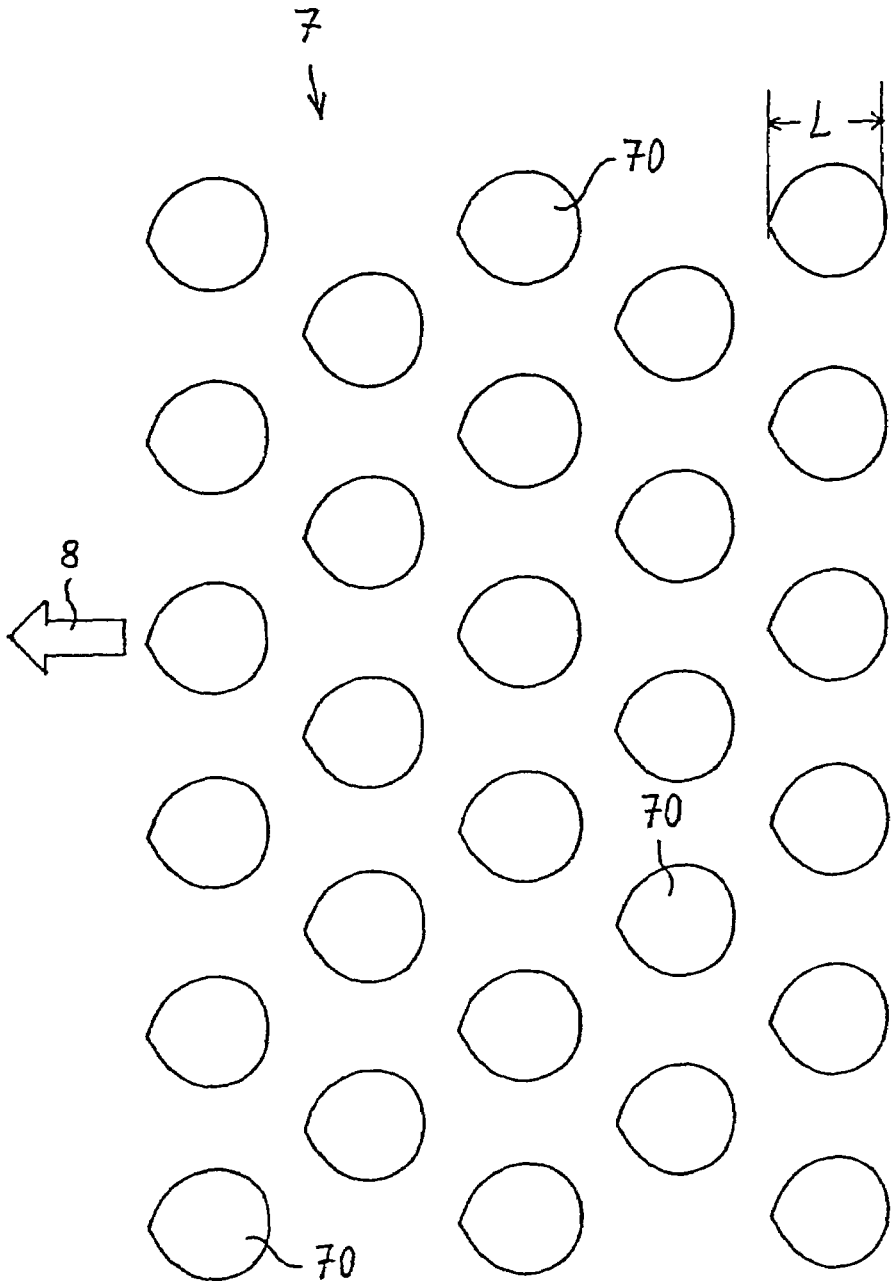
FIG. 1 illustrates a first example of a marking line comprising a plurality of elements.

In the example according to FIG. 1, the individual marking elements 70 have an approximately round, droplet-like form. In the example according to FIG. 2, the individual marking elements 70 have an approximately oval or elliptical form. The longitudinal direction of the marking line 7 extends in direction of the arrow 8 in each case.

As will yet be explained in the following, the device can furthermore create marking lines which comprise a plurality of bulges extending transversely to the longitudinal direction of the marking lines, as well as the usual continuous marking lines.

In the examples according to FIGS. 3 to 9, the device 1 comprises each one housing 11 with a chamber 11' into which pressurized marking material is supplied via a channel-shaped material inlet 10 from a supply system here not shown.

In the device 1 according to FIGS. 3 and 4, a bottom 12 of the housing 11 forms one first discharge element, and a slide 3 under the bottom 12 is guided and resting against it and presents a second discharge element. The slide 3 is moveable relative to the housing bottom 12 in an oscillating fashion in and against the direction of movement 8. For creating this oscillating movement of the slide 3, a piston cylinder unit 30 is used here which can be driven pneumatically or hydraulically, preferably with an adjustable oscillation frequency.

In the presented example, two rows 21' of openings with a circular cross section are arranged in the housing bottom 12, with the two rows 21' extending parallel to each other and transversely to a direction of movement 8 of the device 1.

In slide 3 here plate-shaped in design, a slot 22 extending transversely to the direction of movement 8 is provided as a discharge opening. The two rows 21' of the openings in the bottom 12 and the slot 22 in the slide 3 together form the variable outlet 2 of the device 1 for the marking material to be discharged.

As illustrated in FIGS. 3 and 4, the oscillating movement of slide 3 results in an alternating covering, alternately increasing and decreasing, of the two opening rows 21' with the slot 22, by means of which the pressurized marking material in the chamber 11' is discharged in the form of individual droplets in portions through the outlet 2 onto the surface 6, for example a road surface. A marking line can thus be created, comprising a plurality of individual, approximately droplet-shaped marking material elements.

For the example according to FIGS. 5 and 6, a slot 21 is provided in the bottom 12 of the housing 11 which extends transversely to the direction of movement 8. In the slide 3, two opening rows 22' are provided here which extend parallel to each other and also transversely to the direction of movement 8.

Here again, the slide 3 can be brought to the desired oscillating movement in and against the direction of movement 8, by means of a piston cylinder unit 30. Thus, pressurized marking material can then be discharged, in droplet-shape, from chamber 11' of the housing 11 through the outlet 2 upon movement of the device 1 in the direction of movement 8 and deposited on the surface 6. Even with this device 1 according to FIGS. 5 and 6, a marking line can thus be created which comprises a plurality of individual marking material elements. The device 1 according to FIGS. 7 and 8 comprises in the bottom 12 of the housing 11 as an opening a slot 21 which extends transversely to the direction of movement 8. In the slide 3, a slot 22 is here also provided as an opening, with the slot 22 here having the same size as slot 21 and running parallel with it. The oscillating movement of slide 3 in and against the direction of movement 8 can here also be generated by means of a piston cylinder unit 30. With this movement of the slide 3, the two slots 21 and 22 will be alternately covered and uncovered. Due to this, pressurized marking material is discharged through the outlet 2 from the chamber 11' of the housing 11, in the form of bulges which are aligned parallel to each other and extending transversely to the direction of movement 8 and deposited on the surface 6. The marking line which can thus be created accordingly consists of a plurality of bulge-shaped marking material elements extending transversely to the longitudinal direction of the line and with a minor spacing running parallel to each other.

Figure 9:
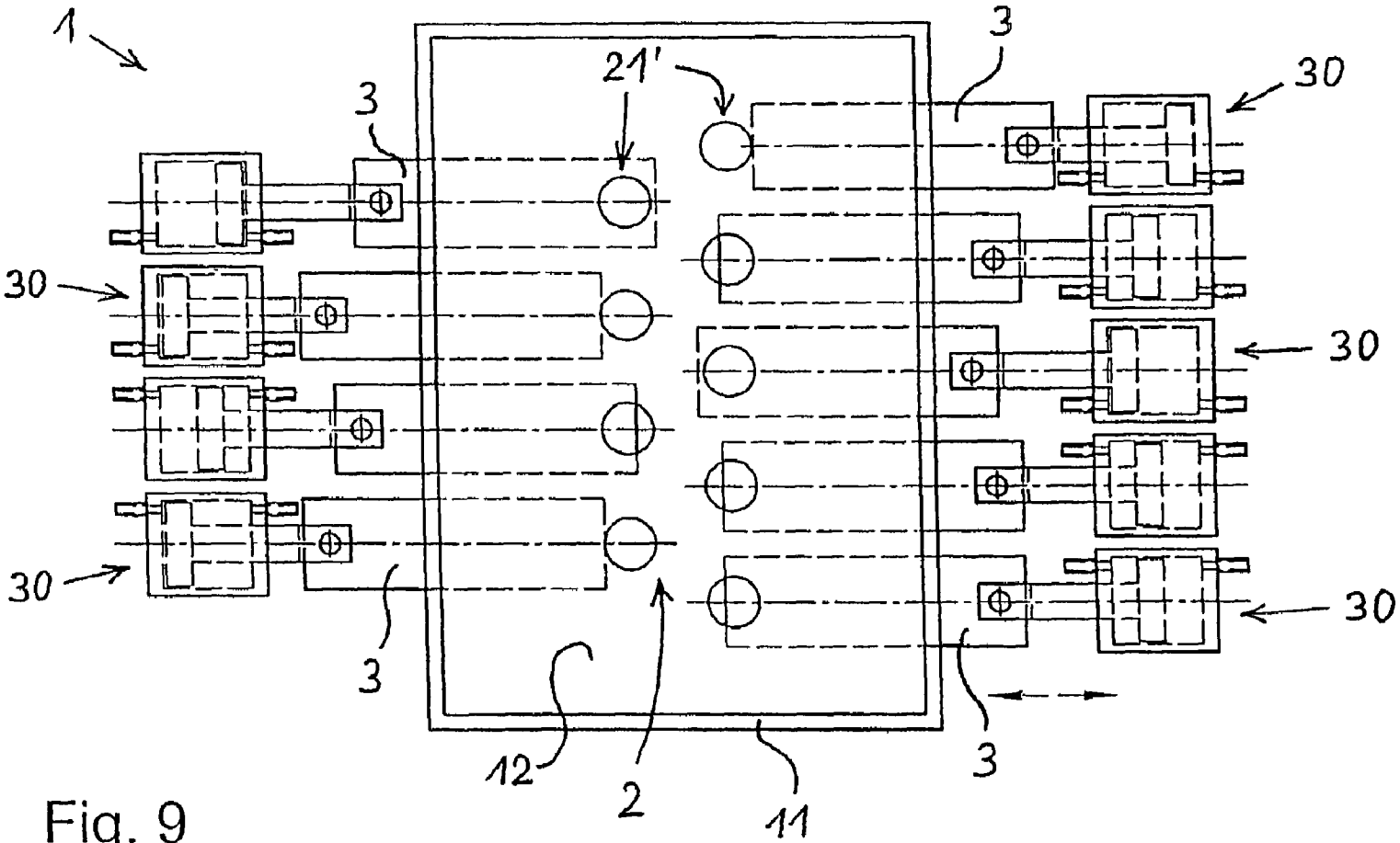
FIG. 9 illustrates a fourth device in a top view.

While the examples of the device 1 according to the FIGS. 3 to 8 each use one single slide 3, the example of the device 1 according to FIG. 9 comprises an arrangement of several slides 3, here a total of seven. In the bottom 12 of the housing 11, two rows 21' of round openings are provided. Every single opening of the two rows 21' is allocated its own slide 3 each. By its own piston cylinder unit 30, every slide 3 can be brought into an oscillating movement in and against the direction of movement 8. These oscillating movements of the individual slides 3 ensure that each opening in the rows 21' is alternately released and closed, with the transition being steady. Through the outlet 2 of the device 1 formed by the opening rows 21' and the slide 3, pressurized marking material in the form of individual droplets can be discharged from the housing 11, whereby a marking line can be created which consists of an arrangement of many individual marking material elements.

Figure 10:
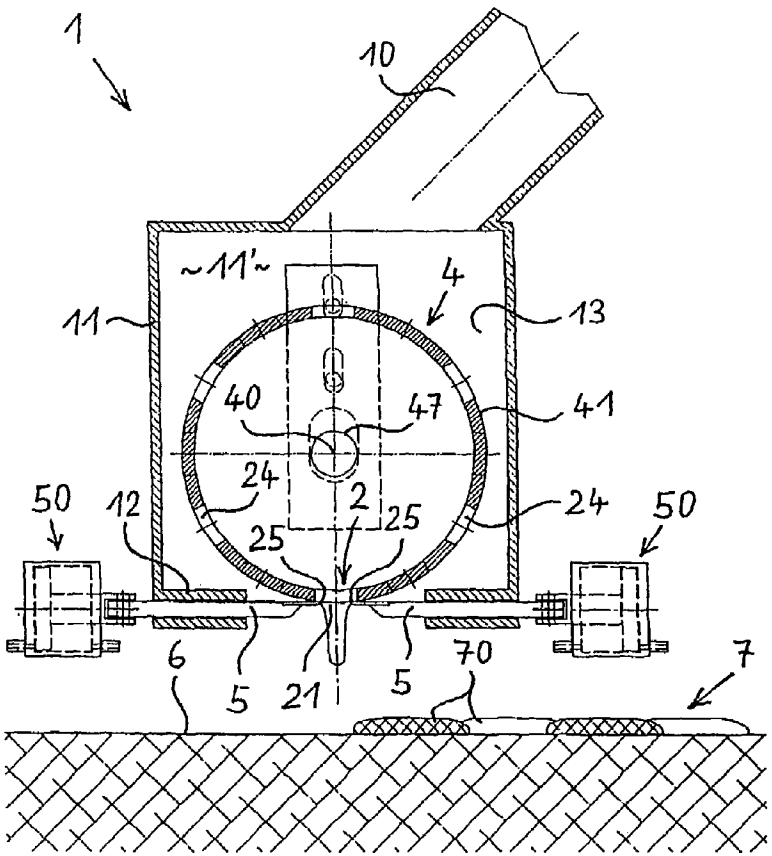
FIG. 10 illustrates a fifth device in a vertical section with the cutting plane in the direction of movement, in an operating condition for creating a marking line comprising a plurality of elements.
Figure 11:
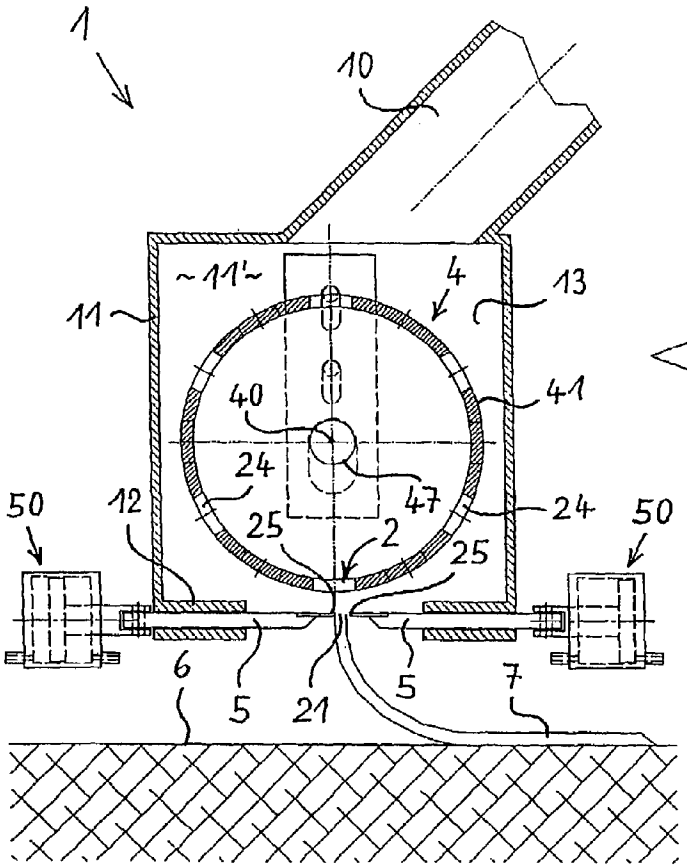
FIG. 11 illustrates the device of FIG. 10 in the same presentation, in an operating condition for creating a continuous marking line.
Figure 12:
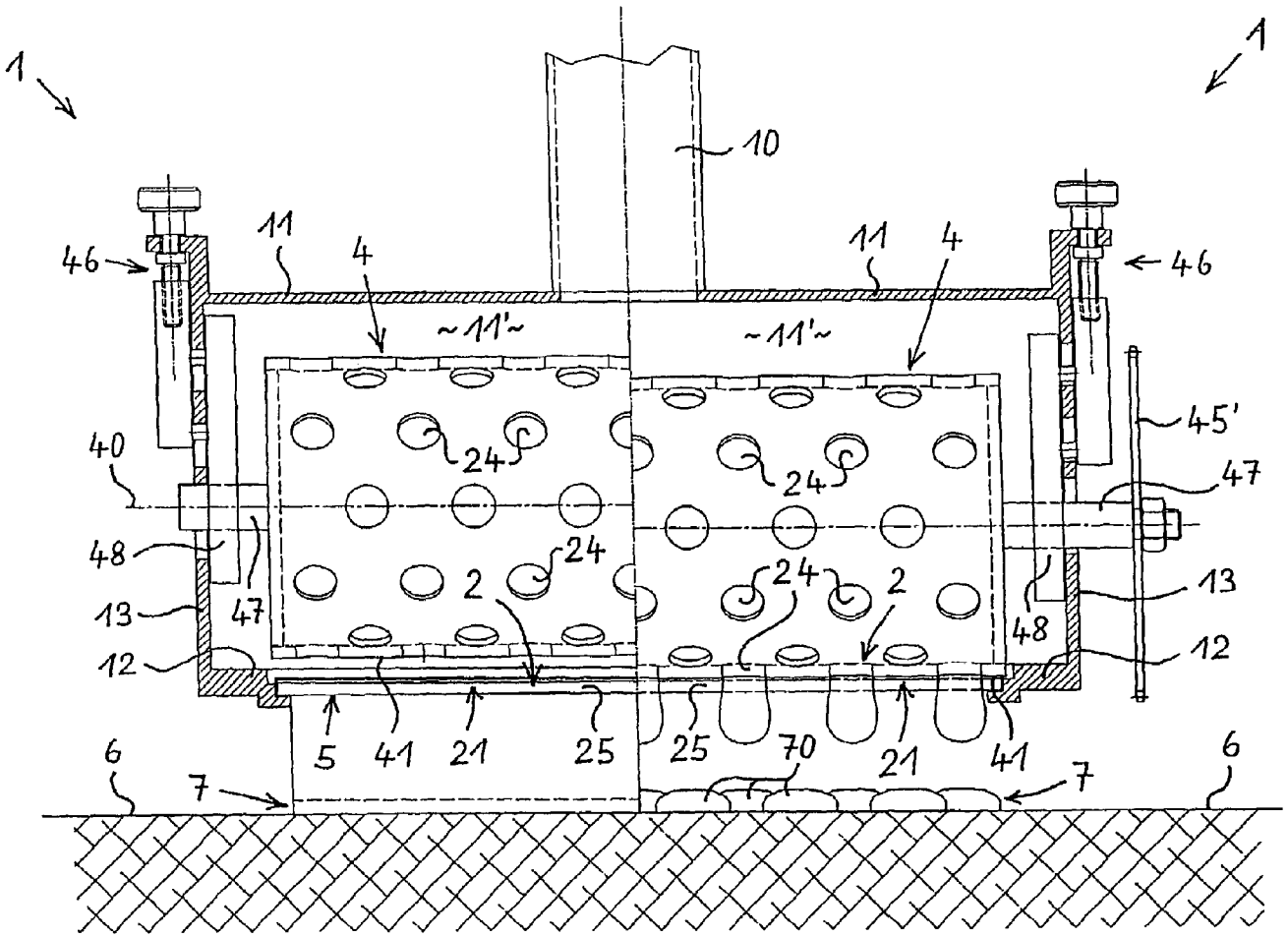
FIG. 12 illustrates the device of FIGS. 10 and 11 in a vertical section with the cutting plane transverse to the direction of movement.

FIGS. 10 to 12 show another example of the device 1. Here again, the device 1 comprises a housing 11 with a chamber 11' into which pressurized marking material is supplied via a channel-shaped material inlet 10 from a supply system not presented. On its side facing a road surface 6, the housing 11 comprises, on its housing bottom 12, two open/closed slides 5 slidable in and against the direction of movement 8 which each form an adjustable discharge opening edge 25. By means of these slides 5, and with the aid of the usual actuating means, here in the form of pneumatic cylinders 50, a slot 21 which forms a discharge opening can be opened or closed on the bottom 12 of the housing 11 and which extends transversely to the direction of movement 8. The length of the slot 21 in transverse direction to the direction of movement 8 is equivalent to the width of a marking line 7 to be created.

Figure 16:
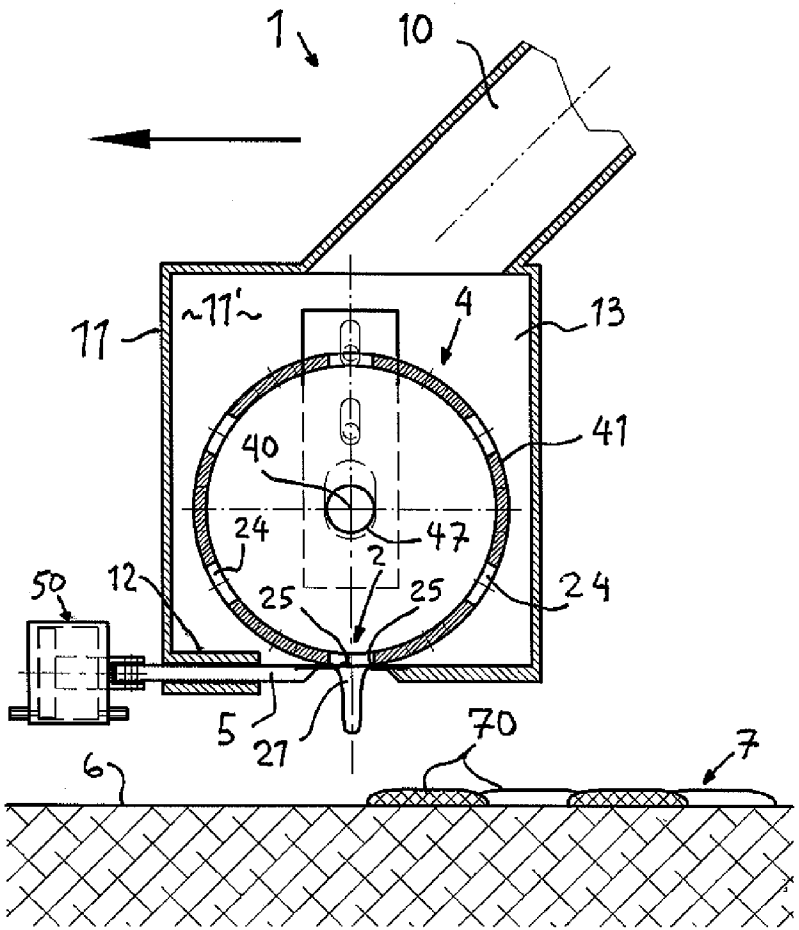
FIG. 16 illustrates a sixth device in a vertical section with the cutting plane in the direction of movement, in an operating condition for creating a making line comprising a plurality of elements.
Figure 17:
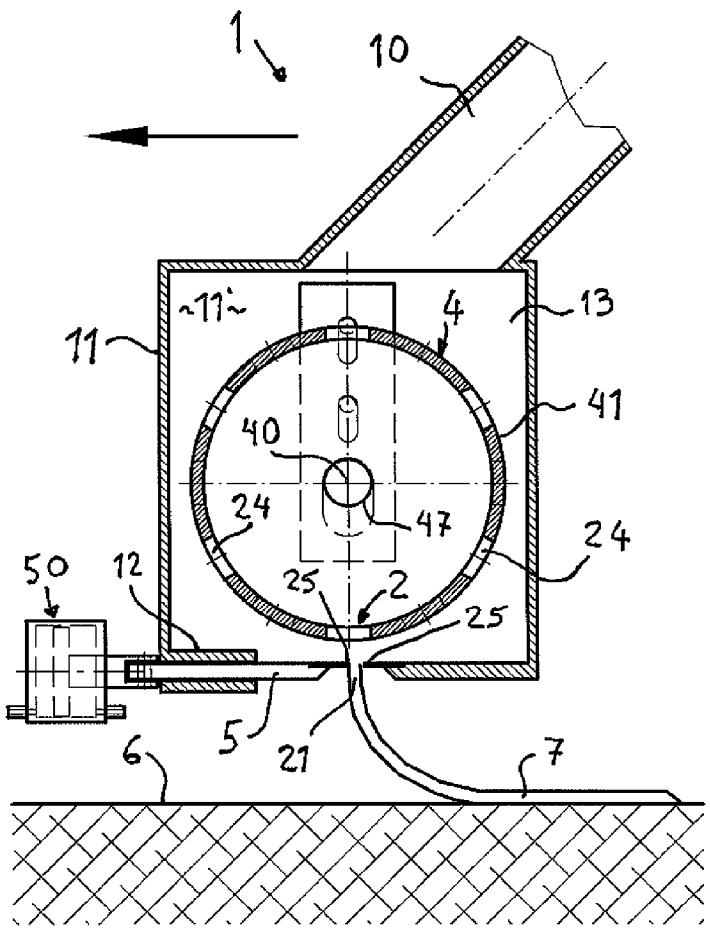
FIG. 17 illustrates the device of FIG. 16 in the same presentation, in an operating condition for creating a continuous marking line.

FIGS. 16 and 17 show an example of the device 1 that is virtually identical to the example shown in FIGS. 10-12, except that only one discharge slot edge comprises a closing slide 5 and the other discharge slot edge comprises a portion of the housing 11.

In the chamber 11', a hollow cylinder 4 islocated, with openings 24 provided in its jacket 41, with two shaft journals 47 which are provided to rotate about axis 40 in shaft bearings 48. The openings 24 in circumferential direction and axial direction of the hollow cylinder 4 are spaced from each other and distributed. Here the openings 24 are lying next to each other on several circumferential lines as FIG. 12 clearly shows.

Versus the lateral housing walls 13 of the housing 11, the shaft bearings 48 are vertically displaceable and can be adjusted in height, as FIG. 12 shows, by means of two adjusting devices 46 with one hand wheel each and one threaded spindle each. By means of this, the hollow cylinder 4 can be shifted between the position presented in the right half of FIG. 12, resting against the discharge opening edges 25 and the position presented in the left half of FIG. 12, spaced apart from the discharge opening edges 25. In this spaced position, the marking material supplied by the material inlet 10 passes unhindered by the hollow cylinder 4 to the slot 21 and, in the opened condition of the open/closed slides 5, as a continuous strip onto the road surface 6 and there forms a continuous, smooth marking line 7.

In the lower position of the hollow cylinder 4 presented in FIG. 10 and in the right part of FIG. 12, the marking material passes only through the interior room of the hollow cylinder 4 and then in portions through the cross sections, just free in the area of the slot 21 toward the outside, of the openings 24 in the hollow cylinder 4, in an exact and reproducible dose from the chamber 11' onto the road surface 6 and there forms the droplet-shaped elements 70 of the marking line 7 upon the simultaneous movement of the device 1 in the direction of movement 8.

Figure 13:
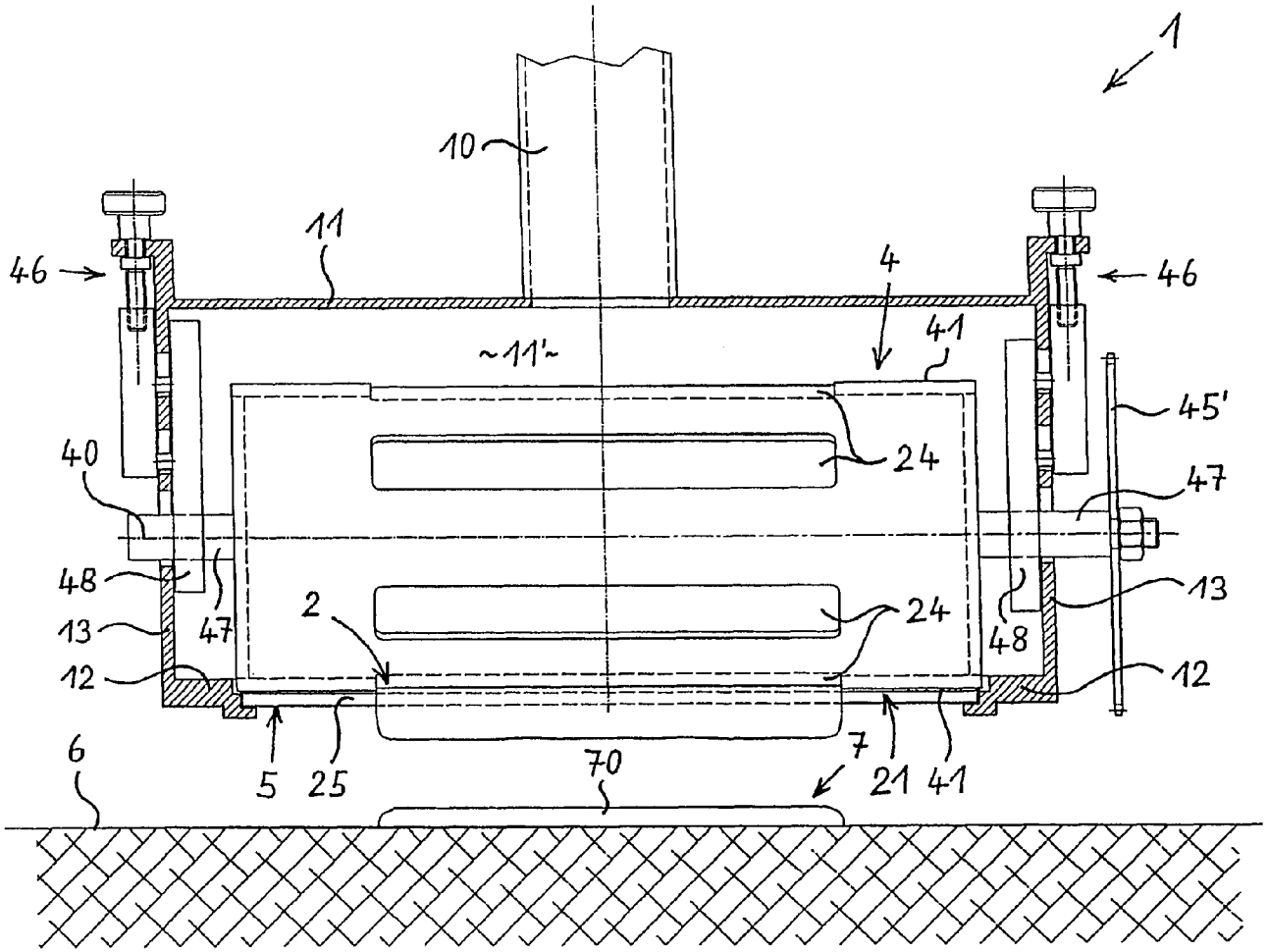
FIG. 13 illustrates a sixth device in a vertical section with the cutting plane transverse to the direction of movement.

FIG. 13 shows one example for a device 1 which corresponds in large part with the device 1 according to the FIGS. 10 to 12. The design of the hollow cylinder 4 varies which, in the example according to FIG. 13, comprises slot-shaped openings 24 in its jacket 41. The openings 24 extend parallel to each other and parallel to the axial direction of the hollow cylinder 4. In the lower position of the hollow cylinder 4, presented in FIG. 13, it rests with the outer circumference of its jacket 41 against the discharge opening edges 25 of the two open/closed slides 5. Here again, the discharge opening edges 25 delimit a slot 21 in the bottom 12 of the housing 11.

With the device 1 according to FIG. 13, pressurized marking material, from the chamber 11' of the housing 11, can be created in the form of bulges extending transversely to the direction of movement (the direction of movement extends in FIG. 13 perpendicularly to the drawing plane) and parallel to each other, with the individual bulges each forming one element 70 of the marking line 7.

When the hollow cylinder 4, in the device 1 according to FIG. 13, is adjusted by means of the adjustment arrangement 46 into its raised position, the device 1 according to FIG. 13 works like the device 1 which is presented and explained in FIG. 11 and in the left half of FIG. 12.

Figure 2:
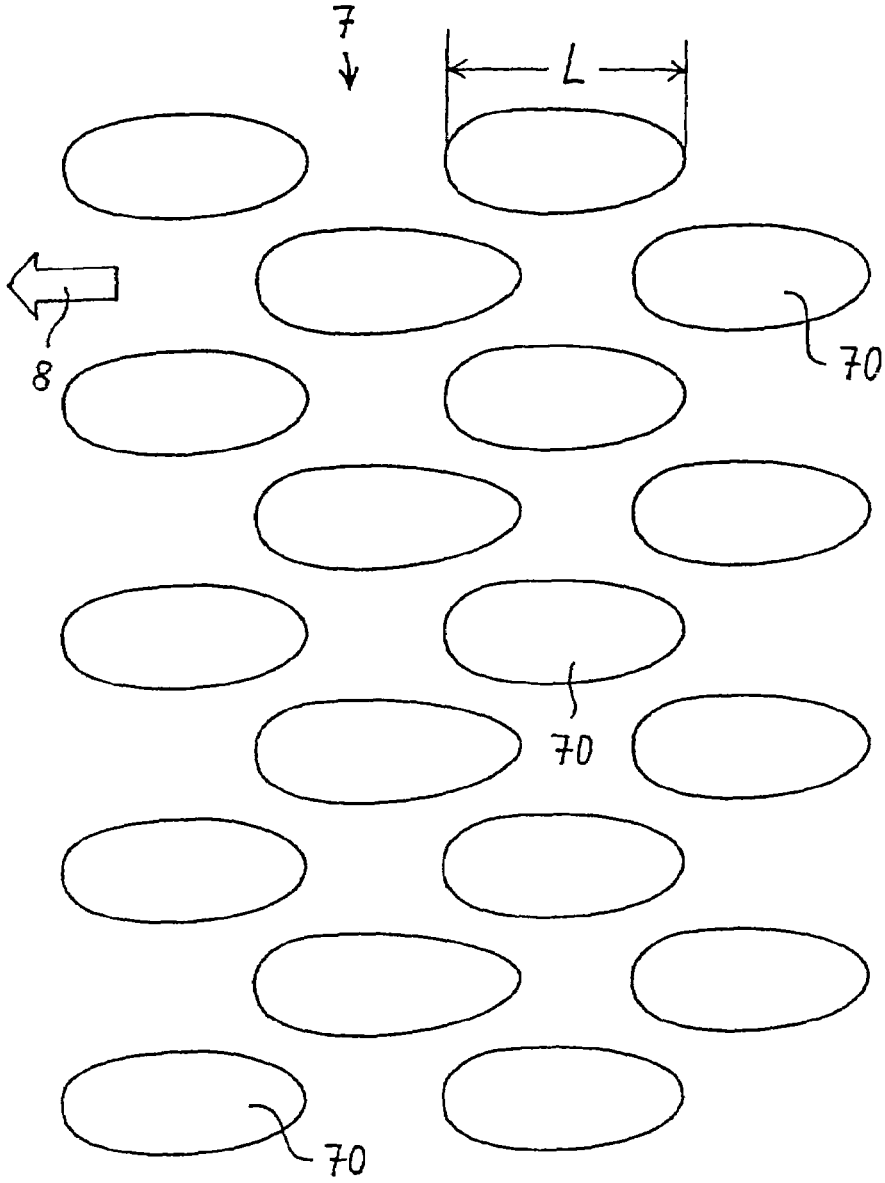
FIG. 2 illustrates a second example of a marking line comprising a plurality of elements.

The length L of the elements 70 in longitudinal direction of the marking line 7 depends on the ratio of the speed of movement of the device 1 to the rotary speed of the hollow cylinder 4. The lower the rotary speed in relation to the speed of movement, the larger the length L of the individual elements 70, as is illustrated in FIGS. 1 and 2.

Figure 14:
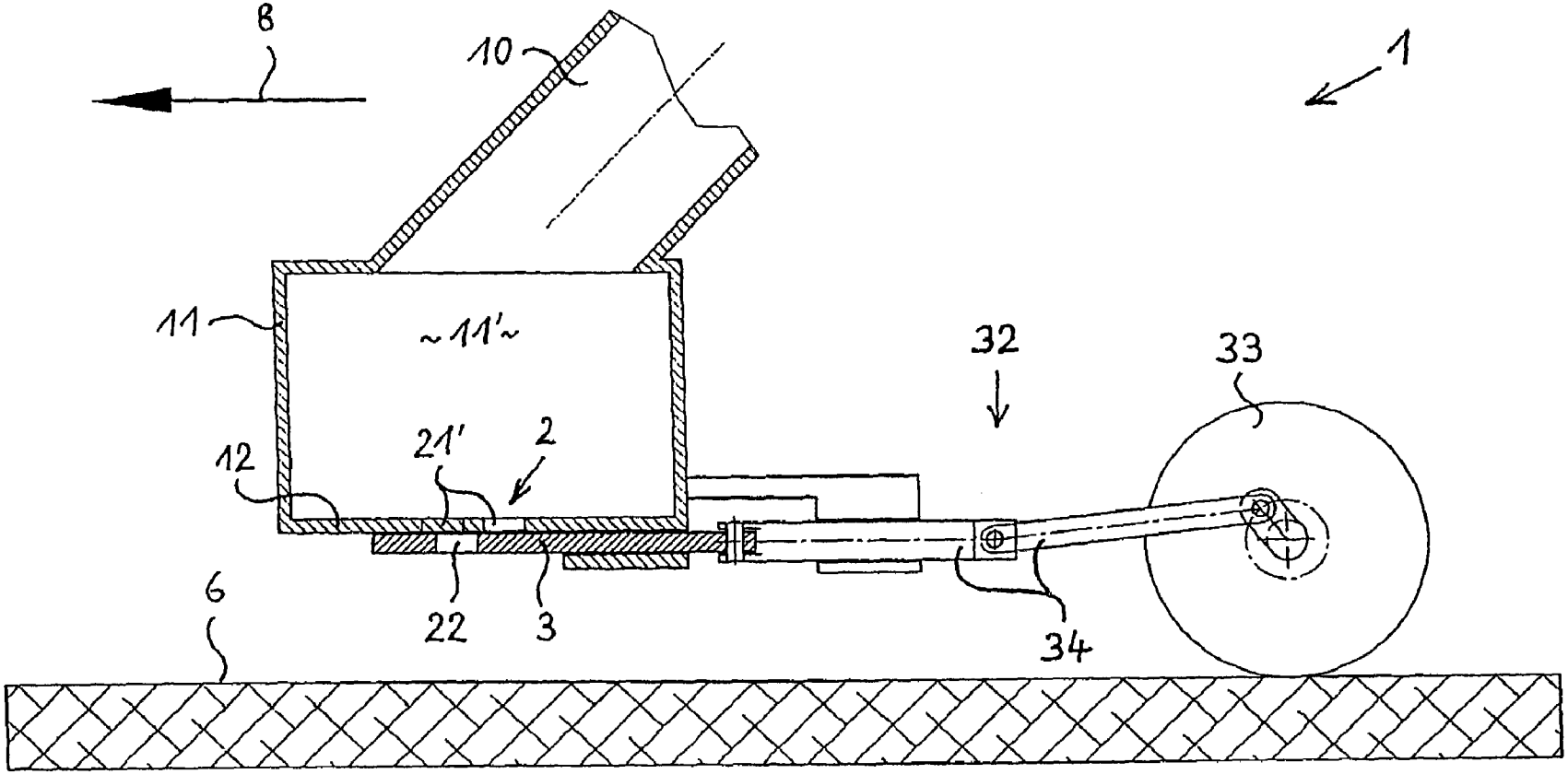
FIG. 14 illustrates a first drive for the device, partly in a side view, partly in vertical section.

In the examples of the device 1 described further above, in which a slide 3 is used, a piston cylinder unit 30 is each presented as the drive unit for the slide 3. FIG. 14 shows an alternative drive unit 32. This drive unit 32 comprises a friction wheel 33 which rolls on the road surface 6 to be provided with the marking line 7 when the device 1 is moved in the direction of movement 8. The friction wheel 33 is coupled with the slide 3 via a crank drive 34. Thus will be achieved that the oscillating movement of the slide 3 occurs in and against the direction of movement 8 with a frequency proportional to the speed of movement of the device 1. Thus, the form of the created marking material elements will be largely independent of the speed of the device 1 relative to the road surface 6.

Figure 15:
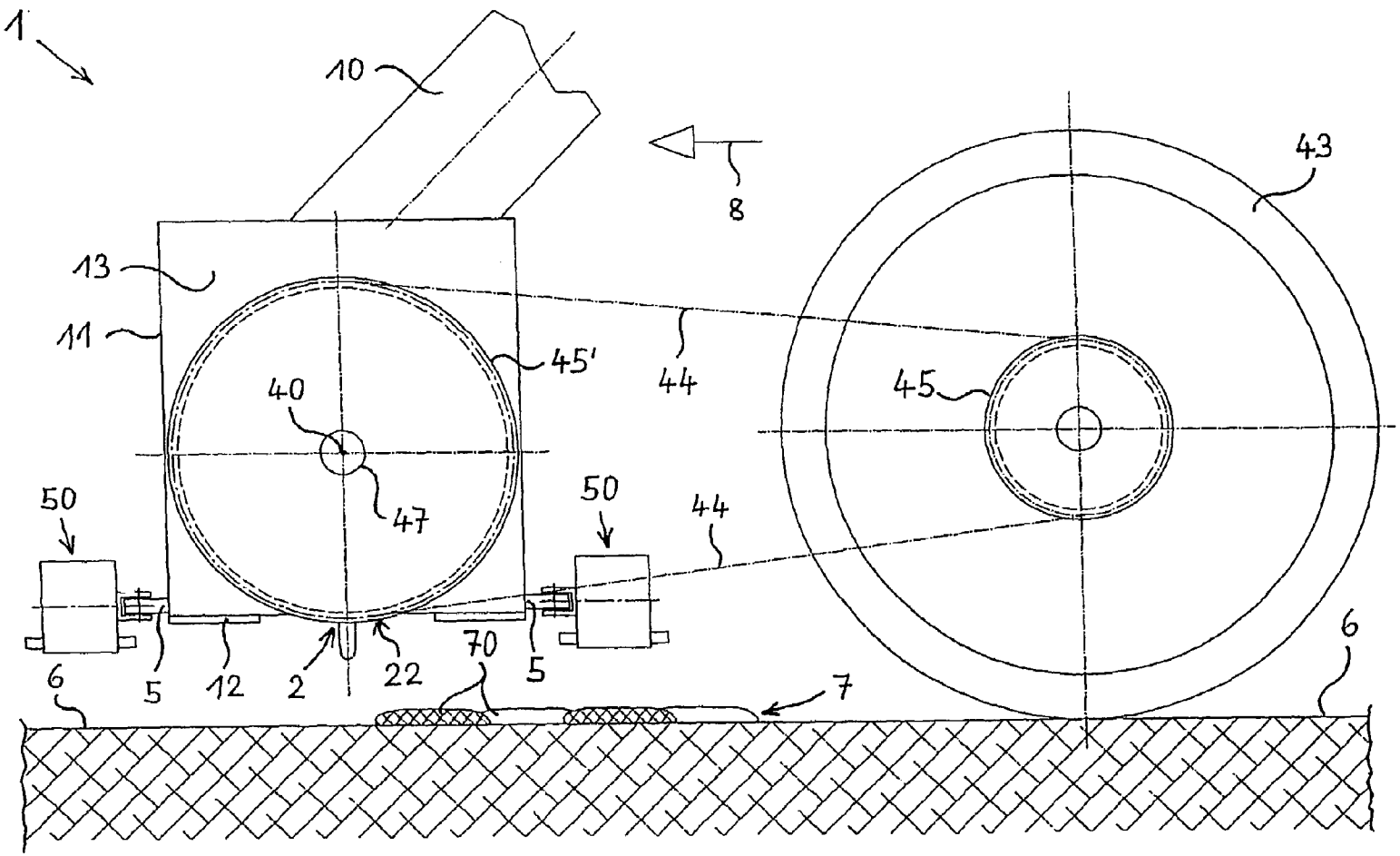
FIG. 15 illustrates a second drive for the device, in a side view.

With the devices 1 in which the hollow cylinder 4 is used, the speed of the hollow cylinder 4 should be preferably proportional to the speed of movement of the device 1 relative to the road surface 6 to create uniformly long elements 70 independent of the speed. This can be achieved according to FIG. 15 in a simple manner by a friction wheel 43 rolling on the road surface 6 which drives the hollow cylinder 4 by means of simple transmission means, here in the form of a chain drive, proportional to the speed of movement of the device 1. The chain drive comprises a chain 44 and two chain wheels 45 and 45'. The chain wheel 45 is connected torsion-proof with the friction wheel 43, the chain wheel 45' is connected torsion-proof with one of the shaft journals 47 of the hollow cylinder 4.

The ratio of the rotary speed of the hollow cylinder 4 to the speed of movement of the device 1, i.e. the length of the elements 70, can be adjusted with the chain drive transmission through a corresponding selection of the chain wheels 45 and 45', and the drive can also be designed shiftable between the different transmissions.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A device carried on a moving vehicle for creating marking lines, which comprise a plurality of elements and are made of a highly viscous marking material, on a surface that is to be marked, comprising:

a housing formed by walls;

a discharge slot formed in at least one of the walls of the housing and extending transversely to a direction of movement of the vehicle, the discharge slot being limited in extent by a front discharge slot edge and a rear discharge slot edge, seen in the direction of movement of the vehicle;

a pressurized material supply line leading to an interior of the housing, a rotary hollow cylinder formed of a jacket located in the interior of the housing and arranged to rotate with the movement of the vehicle carrying the device, the cylinder being provided with a plurality of passages through the jacket, which, depending on a rotary position of the cylinder, establish a connection between the pressurized material supply line and the discharge slot, the rotary cylinder being positioned in the housing with an outer circumferential surface of its jacket spaced at a distance from the walls of the housing and essentially forming a sealing gap only in the area of the discharge slot edges.

2. The device according to claim 1, wherein at least one of the front and rear discharge slot edges comprise a closing slide.

3. The device according to claim 1, wherein only one discharge slot edge comprises a closing slide and the other discharge slot edge comprises a portion of the housing.

4. The device according to claim 1, wherein the rotary cylinder and the discharge slot edges are slidable relative to each other.

5. The device according to claim 4, wherein the rotary cylinder is slidable towards and away from the discharge slot edged, in a direction radial to the cylinder.

6. The device according to claim 4, wherein at least one of the discharge slot edges is slidable tangentially relative to the cylinder.

7. The device according to claim 1, wherein the passages in the rotary cylinder jacket which connect the interior of the housing with the discharge slot, depending on the rotary position of the rotary cylinder, comprise slots which extend parallel to an axis of the rotary cylinder.

8. The device according to claim 1, wherein the rotary cylinder is adjustably positionable in a direction perpendicular to an axis of the rotary cylinder to a selected position relative to the discharge slot edges.

9. The device according to claim 1, further including a drive ensuring a rotational driving of the rotary cylinder with a speed proportional to a speed of movement of the device relative to the surface.

10. The device according to claim 9, wherein the drive comprises a surface engaging wheel and a chain drive engaged between the wheel and the cylinder.

11. The device according to claim 10, wherein the drive further comprises a first chain wheel associated with the wheel and a second chain wheel associated with the cylinder, whereby a desired ratio of rotational speed of the wheel to rotational speed of the cylinder can be selected based upon a selected diameter of the first chain wheel and the second chain wheel.

12. A device carried on a moving vehicle for creating marking lines, which comprise a plurality of elements and are made of a highly viscous marking material, on a surface that is to be marked, comprising:

a housing formed by walls and having an interior space, a discharge slot formed in at least one of the walls of the housing and extending transversely to a direction of movement of the vehicle, the discharge slot being limited in extent by a front discharge slot edge and a rear discharge slot edge, defined in accordance with a direction of movement of the vehicle, a material supply line leading to the interior space of the housing, a rotary cylinder formed of a hollow jacket located in the interior space of the housing and arranged to rotate with the movement of the vehicle, the cylinder having at least one passage through the jacket, which, depending on a rotary position of the cylinder, establishes a flow path between the pressurized material supply line and the discharge slot, the rotary cylinder being positioned in the housing with an outer circumferential surface of its jacket spaced at a distance from the walls of the housing and forming a sealing gap with the housing only in an area of the discharge slot edges.

13. The device according to claim 12, wherein both the front discharge slot edge and rear discharge slot edge comprise closing slides.

14. The device according to claim 12, wherein the rotary cylinder and the discharge slot edges are slidable relative to each other.

15. The device according to claim 12, wherein the rotary cylinder is slidable towards and away from the discharge slot edges, in a direction radial to the cylinder.

16. The device according to claim 14, wherein at least one of the discharge slot edges is slidable tangentially relative to the cylinder.

17. The device according to claim 12, wherein the at least one passage in the rotary cylinder jacket which connects the interior of the housing with the discharge slot, depending on the rotary position of the rotary cylinder, comprise at least one slot which extends parallel to an axis of the rotary cylinder.

18. The device according to claim 12, wherein the rotary cylinder is adjustably positionable in a direction perpendicular to an axis of the rotary cylinder to a selected position relative to the discharge slot edges.

19. The device according to claim 12, further including a drive ensuring a rotational driving of the rotary cylinder with a speed proportional to a speed of movement of the device relative to the surface.

20. The device according to claim 19, wherein the drive comprises a surface engaging wheel and a chain drive engaged between the wheel and the cylinder.

* * * * *